US006454688B1

(12) United States Patent
Okuda et al.

(10) Patent No.: US 6,454,688 B1
(45) **Date of Patent: *Sep. 24, 2002**

(54) CHARGING ROLL WHOSE OUTERMOST LAYER CONTAINS GRAFTED CARBON

(75) Inventors: Hirofumi Okuda, Aichi-ken; Yuichiro Maruyama, Komaki; Hiroyasu Kato, Bisai; Hiroki Sugiura, Komaki, all of (JP)

(73) Assignee: Tokai Rubber Industries, Ltd., Komaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/427,559

(22) Filed: Oct. 26, 1999

(30) Foreign Application Priority Data

Oct. 30, 1998 (JP) ..... 10-310146

(51) Int. Cl.[7] ..... B25F 5/02
(52) U.S. Cl. ..... 492/56; 492/53; 428/35.9
(58) Field of Search ..... 492/56, 49, 53, 492/59; 428/35.9, 465, 335; 29/895.32; 399/176, 174, 313

(56) References Cited

U.S. PATENT DOCUMENTS

| | | | | | |
|---|---|---|---|---|---|
| 4,128,673 | A | * | 12/1978 | Watanabe et al. | 427/130 |
| 4,940,749 | A | * | 7/1990 | Mori et al. | 524/547 |
| 4,983,488 | A | * | 1/1991 | Tan et al. | 430/137 |
| 4,983,681 | A | * | 1/1991 | Mori et al. | 525/290 |
| 4,994,520 | A | * | 2/1991 | Mori et al. | 524/547 |
| 5,141,788 | A | * | 8/1992 | Badesha et al. | 428/36.8 |
| 5,312,662 | A | * | 5/1994 | Ohta et al. | 492/56 |
| 5,316,885 | A | * | 5/1994 | Sasaki et al. | 430/200 |
| 5,415,612 | A | * | 5/1995 | Carlson et al. | 492/56 |
| 5,849,399 | A | * | 12/1998 | Law et al. | 492/56 |
| 5,925,893 | A | * | 7/1999 | Ishii et al. | 257/40 |
| 5,952,429 | A | * | 9/1999 | Ikeda et al. | 525/326.1 |
| 5,993,366 | A | * | 11/1999 | Kaji et al. | 492/56 |
| 6,004,669 | A | | 12/1999 | Rokutan et al. | |
| 6,009,299 | A | * | 12/1999 | Ishihara et al. | 399/324 |
| 6,066,400 | A | * | 5/2000 | Law et al. | 428/412 |
| 6,090,492 | A | * | 7/2000 | Tsuchiya et al. | 492/53 |
| 6,096,395 | A | * | 8/2000 | Hayashi et al. | 428/35.9 |
| 6,141,516 | A | * | 10/2000 | Law et al. | 399/176 |
| 6,142,922 | A | * | 11/2000 | Yoshikawa et al. | 492/56 |
| 6,183,929 | B1 | * | 2/2001 | Chow et al. | 430/124 |
| 6,190,295 | B1 | * | 2/2001 | Kawano et al. | 492/56 |
| 6,283,904 | B1 | * | 9/2001 | Itoh et al. | 492/56 |

FOREIGN PATENT DOCUMENTS

| | | | |
|---|---|---|---|
| EP | 0 787 777 | A1 | 8/1997 |
| EP | 0 997 789 | A2 * | 3/2000 |
| JP | 403233473 | A * | 10/1991 |
| JP | 7-228820 | | 8/1995 |
| JP | 9-59331 | | 3/1997 |
| JP | 9-272706 | | 10/1997 |
| JP | 10 148997 | | 6/1998 |
| JP | 10 186794 | A | 7/1998 |
| JP | 2000006260 | A * | 1/2000 |

* cited by examiner

*Primary Examiner*—S. Thomas Hughes
*Assistant Examiner*—Marc Jimenez
(74) *Attorney, Agent, or Firm*—Burr & Brown

(57) ABSTRACT

A charging roll which is held in rolling contact with a photosensitive drum for charging the photosensitive drum. The charging roll includes an outermost layer formed of a resin composition containing a grafted carbon as an electrically conductive agent. The grafted carbon includes a carbon black and a polymer which is grafted on the carbon black so as to cover a surface of the carbon black.

16 Claims, 1 Drawing Sheet

CHARGING ROLL WHOSE OUTERMOST LAYER CONTAINS GRAFTED CARBON

This application is based on Japanese Patent Application No. 10-310146 filed Oct. 30, 1998, the content of which is incorporated hereinto by reference.

BACKGROUND OF THE INVENTION

1. Field of the Invention

The present invention relates to a charging roll for use in an image forming apparatus such as an electrophotographic copying machine or printer.

2. Discussion of the Related Art

There is known a charging roll which is installed in an image forming apparatus such as an electrophotographic copying machine or printer, such that the charging roll is held in rolling contact with a photosensitive drum for charging the circumferential surface of the photosensitive drum. More specifically described, such a charging roll is used in a so-called "roll charging" method which is one of the known methods for charging a photosensitive drum on which an electrostatic latent image is formed. In the roll charging method, the charging roll to which a charging voltage is applied is held in pressing contact with the outer circumferential surface of the photosensitive drum. The charging roll and the photosensitive drum are rotated together so that the outer circumferential surface of the photosensitive drum is evenly charged by the charging roll.

Since the charging roll is held in rolling contact with the outer circumferential surface of the photosensitive drum, the charging roll is required to have a low hardness (high softness) and high flexibility. Further, the charging roll is required to have a suitable degree of electric conductivity, so as to effectively charge the photosensitive drum.

In recent years, there is an increasing demand for higher image forming capability and excellent energy-saving characteristics of the image forming apparatus, as well as higher process speed and excellent durability of the image forming apparatus. In an attempt to improve the energy-saving characteristics for reducing the electric power to be consumed by the image forming apparatus, the melting point of the toner is lowered for the purpose of fixing the toner on a recording medium at a lower temperature. Further, for improving the performance of the image forming apparatus to provide sufficiently high image quality, the size of the toner particles is made smaller.

However, when the melting point of the toner is lowered or the size of the toner particles is made smaller, the toner undesirably tends to adhere to the charging roll which is inevitably heated in the image forming apparatus during its operation. The toner which adheres or clings to the charging roll causes deterioration of the image forming capability of the image forming apparatus. Described more specifically, with an increase in the number of copying or printing operations, in other words, with an increase in the number of operations to develop the electrostatic latent images into visible toner images on the outer circumferential surface of the photosensitive drum, the electric resistance of the charging roll tends to be raised as a whole due to the adhesion of the toner to the charging roll. Further, uneven adhesion of the toner to local portions of the roll causes a variation in the electric resistance of the roll at the local portions. As a result, the image to be formed or reproduced by the image forming apparatus is undesirably deteriorated.

Recently, there is an increasing demand for an image forming apparatus capable of reproducing a color image. In the reproduction of the color image, a non-magnetic one-component toner is generally used to establish a desired hue or color. The non-magnetic one-component toner tends to be easily charged in the absence of a magnetic component such as magnetite or ferrite therein, which serves as a black-color pigment. Thus, for controlling the amount of charging of the toner, a large amount of finely particulate additives such as $SiO_2$, $TiO_2$ or $Al_2O_3$ are added to the toner.

Conventionally, a suitable amount of carbon black or other electrically conductive agent is added to a material which constitutes a surface layer (outermost layer) of the charging roll, so that the surface layer has a desired value of electric resistance. In general, the surface layer of the charging roll is required to have a volume resistivity within a range of about $10^7$–$10^{15}$ Ω·cm. For controlling the volume resistivity within such a limited range, there is proposed the use of an electrically conductive agent which does not excessively influence or reduce the electric resistance, so that the electric resistance does not greatly change with a change of the amount of the conductive agent to be added to the material of the surface layer. Thus, the use of such an electrically conductive agent permits the volume resistivity to be finely controlled by adding a large amount of the electrically conductive agent to the material of the surface layer, without necessity of a delicate adjustment of the amount of the conductive agent to be added. However, the carbon black or the large amount of the conductive agent added to the material of the surface layer leads to an increased size of the secondary particles of the carbon black and an increased amount of the conductive agent exposed on the surface of the charging roll. Thus, the surface of the charging roll is activated and considerably roughened with a multiplicity of minute recesses and projections, due to the increased size of the secondary particles and the increased amount of the exposed conductive agent, whereby the toner and additives included in the toner are more likely to stick or adhere to the activated surface of the exposed conductive agent, or to accumulate in the recesses of the rough surface of the charging roll, causing the above-described variation in the electric resistance at the local portions of the surface of the roll, and accordingly making it difficult to establish an even distribution of the electric resistance over the entire surface area of the charging roll. As a result, the image formed or reproduced by the image forming apparatus is likely to be problematically deteriorated.

SUMMARY OF THE INVENTION

It is therefore an object of the present invention to minimize a local variation of the electric resistance value of the surface layer of a charging roll, by preventing adhesion or accumulation of toner and additives to or on the outer surface of the charging roll, for preventing deterioration of an image formed by an image forming apparatus on which the charging roll is installed.

It is another object of this invention to provide a charging roll which has an improved ease of control of the electric resistance value, a sufficiently even distribution of the electric resistance value of the surface layer of the charging roll, and improved smoothness of the outer surface of the charging roll.

The above objects may be achieved according to the principle of the present invention which provides a charging roll that is held in rolling contact with a photosensitive drum for charging the photosensitive drum. The charging roll includes an outermost layer formed of a resin composition containing a grafted carbon as an electrically conductive agent. The grafted carbon includes a carbon black and a polymer which is grafted on the carbon black so as to cover a surface of the carbon black.

In a conventional charging roll, a carbon black is used as an electrically conductive agent which is a constituent of the resin composition forming the outermost layer. In the charging roll constructed according to the present invention, on the other hand, the electrically conductive agent is constituted by the grafted carbon which is obtained by grafting the suitable polymer on the carbon black. The carbon black is coated with the grafted polymer, and active points or spots on the surface of the carbon black are accordingly covered by the grafted polymer. This covering of the active spots by the grafted polymer advantageously provides improved dispersibility of particles of the carbon black and also a minimized agglomeration or cohesion of the carbon black particles, leading to a sufficiently even distribution of the electric resistance value and improved smoothness of the outer surface of the charging roll. Further, the covering of the surface of the carbon black by the grafted polymer provides other advantages that the ease of control of the electric resistance is improved, and that there is no risk of chemical bonding between the carbon black and the toner even where the grafted carbon as the electrically conductive agent is exposed on the outer surface of the roll. Therefore, the arrangement according to the principle of the invention is effective to facilitate removal of the toner and additives from the outer surface of the roll, and accordingly prevent or minimize adhesion or accumulation of the toner and additives to or on the surface of the roll.

According to a first preferred form of the present invention, the weight ratio of the polymer which is grafted onto the carbon black, to the carbon black in the grafted carbon is 0.2–1.0, thereby making it possible to maximize the advantages provided by the use of the grafted carbon as the electrically conductive agent.

According to a second preferred form of the invention, wherein a content of the grafted carbon in the resin composition is 5–50 wt. %, thereby increasing the electric conductivity of the outermost layer and advantageously establishing a desired value of the electric resistance.

According to a third preferred form of the invention, the charging roll has a surface which is constituted by an outer surface of the outermost layer and which has a surface roughness: Rz (ten point height of irregularities) of not larger than 3 $\mu$m, whereby the adhesion or accumulation of the toner and additives to or on the surface of the roll is more effectively prevented or minimized.

According to a fourth preferred form of the invention, the outermost layer has a volume resistivity within a range of $10^7$–$10^{15}$ Ω·cm, so that the charging roll effectively functions as a charging roll.

According to a fifth preferred form of the invention, the resin composition forming the outermost layer includes at least a fluorine-modified acrylate resin as a resin component of the resin composition.

According to one advantageous arrangement of the fifth preferred form, the resin composition further includes at least one of a fluorinated olefin resin and a fluorine-unmodified acrylate resin in addition to the fluorine-modified acrylate resin.

In the charging roll according to this fifth preferred form, it is possible to assure easier removal of the toner and additives from the surface of the roll, and further effectively minimize or prevent the adhesion or accumulation of the toner or additives to or on the surface of the roll.

According to a sixth preferred form of the invention, the charging roll further includes a center shaft, a soft base layer formed on an outer circumferential surface of the center shaft, a resistance adjusting layer formed radially outwardly of the soft base layer, and a protective layer formed outwardly of the resistance adjusting layer and serving as the outermost layer.

According to one advantageous arrangement of the sixth preferred form, the soft base layer consists of a solid elastic body which is electrically conductive.

According to another advantageous arrangement of the sixth preferred form, the soft base layer consists of a foam body which is electrically conductive.

According to a seventh preferred form of the invention, the charging roll further includes a softener-blocking layer interposed between the soft base layer and the resistance adjusting layer, whereby bleeding of a softener such as an oil from the soft base layer is minimized or prevented by the softener-blocking layer.

BRIEF DESCRIPTION OF THE DRAWINGS

The above and optional object, features, advantages and technical significance of the present invention will be better understood by reading the following detailed description of presently preferred embodiments of the invention, when considered in conjunction of the accompanying drawings, in which.

DETAILED DESCRIPTION OF THE PREFERRED EBMODIMENT

Figure 1:
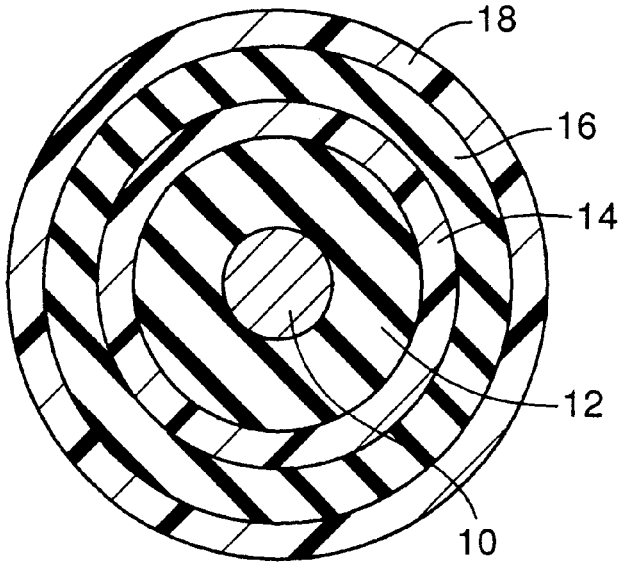
FIG. 1 is a transverse cross sectional view of a charging roll constructed according to a first embodiment of the present invention.

Referring first to FIG. 1, there is shown a charging roll constructed according to a first embodiment of the present invention. The charging roll of FIG. 1 includes an electrically conductive center shaft (metal core) 10 made of a metallic material, and a soft base layer 12 which is formed on the outer circumferential surface of the center shaft 10 and constituted by an electrically conductive solid elastic body having a relatively low hardness. On the outer circumferential surface of the soft base layer 12, there are laminated a softener-blocking layer 14, a resistance adjusting layer 16 and a protective layer 18 in the order of the description in the radially outward direction of the roll. The protective layer 18 constitutes an outermost layer of the roll. Each of the layers 12, 14, 16, 18 has a predetermined suitable thickness value.

Figure 2:
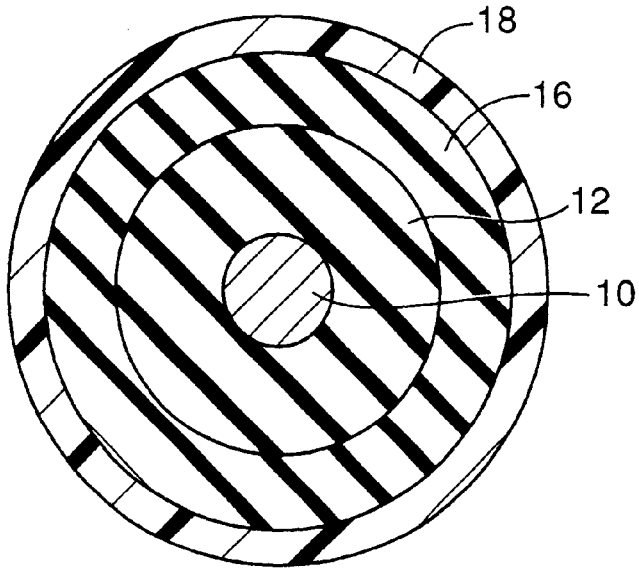
FIG. 2 is a transverse cross sectional view of a charging roll constructed according to a second embodiment of the present invention.

Referring next to FIG. 2, there is shown a charging roll of a second embodiment of the present invention in which the soft base layer 12 is constituted by an electrically conductive foam body, and the softener-blocking layer 14 is not interposed between the soft base layer 12 and the resistance adjusting layer 16.

Described more specifically, the soft base layer 12 formed on the outer circumferential surface of the center shaft 10 is formed of any known electrically conductive elastic material or any known electrically conductive foamable material, so that the soft base layer 12 to be obtained has a hardness adjusted to about 30° (Hs: JIS-A hardness, JIS: Japanese Industrial Standard) for giving the charging roll essentially required properties of low hardness (high softness) and high flexibility. The elastic material used for providing the electrically conductive solid elastic body may consist solely of any known rubber material such as EPDM, SBR, NR, polynorbornene rubber, or may be a mixture of two or more of those rubber materials. The foamable material used for providing the electrically conductive foam body is not particularly limited, but may be suitably selected from among any known foamable materials such as epichlorohydrin rubber, NBR, urethane rubber, hydrogenated NBR, and EPDM, as long as the foamable material used has a sufficient resistance to fatigue of the obtained foam body, and the obtained foam body satisfies the characteristics required for the charging roll. The foamable material is foam by using a known foaming agent or blowing agent such as azodicarbonamide, 4,4-oxybisbenzene sulfonylhydrazide, dinitroso pentamethylene tetramine or $NaHCO_3$. To the elastic material or the foamable material as described above, there is added an electrically conductive agent such as carbon black, metal powder or quaternary ammonium salt, so that the obtained base layer 12 has a desired volume resistivity value. When the base layer 12 is constituted by the solid elastic body, the elastic material for the solid elastic body further includes a relatively large amount of softener such as a process oil or a liquid polymer, so that the obtained base layer 12 has sufficiently low hardness and sufficiently high flexibility.

When the soft base layer 12 is constituted by the electrically conductive solid elastic body as described above, the obtained base layer 12 generally has a volume resistivity of about $10^1$–$10^4$ Ω·cm, and a thickness of about 1–10 mm, preferably, about 2–4 mm. When the soft base layer 12 is constituted by the electrically conductive foam body, the obtained base layer 12 generally has a volume resistivity of about $10^3$–$10^6$ Ω·cm, and a thickness of about 2–10 mm, preferably about 3–6 mm.

The charging roll of FIG. 1 includes the softener-blocking layer 14 disposed on the outer circumferential surface of the soft base layer 12. The softener-blocking layer 14 is formed of a material similar to a material conventionally used for forming a softener-blocking layer, e.g., a mixture of a nylon material such as N-methoxymethylated nylon and an electrically conductive agent such as carbon black or metal powder. The softener-blocking layer 14 made of the mixture thus prepared has a volume resistivity of about $10^1$–$10^5$ Ω·cm, preferably about $10^3$ Ω·cm, and a thickness of generally about 3–20 μm, preferably about 4–10 μm.

The charging roll of the present invention includes the resistance adjusting layer 16 which is disposed radially outwardly of the soft base layer 12 via the softener-blocking layer 14 interposed therebetween in the first embodiment shown in FIG. 1, or which is formed directly on the outer circumferential surface of the soft base layer 12 in the second embodiment shown in FIG. 2. The resistance adjusting layer 16 is formed of a material similar to a material conventionally used for forming a resistance adjusting layer, e.g., a rubber material such as NBR, epichlorohydrin rubber and acrylic rubber. To the rubber material, there is added an electrically conductive agent such as quaternary ammonium salt, and an antistatic agent. The resistance adjusting layer 16 has a thickness of about 50–300 μm, and has a volume resistivity of about $10^8$–$10^{11}$ Ω·cm (where the soft base layer 12 is constituted by the electrically conductive solid elastic body), or a volume resistivity of about $10^5$–$10^9$ Ω·cm (where the soft base layer 12 is constituted by the electrically conductive foam body). The thus formed resistance adjusting layer 16 controls the electric resistance of the charging roll, to thereby increase the withstand voltage or improve the dielectric breakdown resistance (resistance to leakage of electric current) of the charging roll.

The charging roll of the present invention further includes the outermost layer in the form of the protective layer 18 having a predetermined suitable thickness value, as shown in FIGS. 1 and 2. The primary characteristic of the present invention is to form the protective layer 18 of a resin composition containing an electrically conductive agent in the form of a grafted carbon which is formed by grafting a polymer on a surface of carbon black. The use of the resin composition containing the grafted carbon as the electrically conductive agent is effective to provide improved controllability of the electric resistance in the charging roll, a sufficiently even distribution of the electric resistance value of the charging roll, and improved smoothness of the outer surface of the charging roll, thereby effectively eliminating the conventionally experienced problem of deterioration of the formed image due to the adhesion or accumulation of the toner and additives to or on the roll surface.

The grafted carbon contained in the resin composition which gives the protective layer 18 has a known structure in which the polymer grafted on the carbon black includes reactive groups which react with carboxyl groups, hydroxyl groups or other functional groups which exist on the surface of the carbon black. JP-A-09-59331, JP-A-09-272706 and other publications specifically describe various forms of the thus constructed grafted carbon, any one of which can be used as the electrically conductive agent contained in the outermost layer of the charging roll of the present invention.

The carbon black as a material used for providing the grafted carbon is not particularly limited, but may be suitably selected from among any known carbon black materials, as long as the selected carbon black has a carboxyl group, a hydroxyl group or other functional group on its surface. However, carbon black having a pH of not larger than 5 is preferably used so that the carbon black efficiently reacts with the polymer. If carbon black having a pH of larger than 5 is used, the polymer is less likely to be sufficiently grafted on the surface of the carbon black, whereby the dispersibility of particles of the carbon black is not satisfactorily improved and accordingly the agglomeration or cohesion of the carbon black particles is not sufficiently prevented, making it difficult to obtain a high degree of surface smoothness of the protective layer and to control the electric resistance of the charging roll.

The polymer used to be grafted on the carbon black is not particularly limited, but may be suitably selected from among various kinds of known polymers such as polysiloxane, acrylic polymer, methacrylic polymer, styrene-acrylic polymer, polyurethane, polyether, polyester, polyamide, and polyimide, as long as the selected polymer has a reactivity with the functional group existing on the surface of the carbon black, namely, as long as the selected polymer has a reactive group that can be bonded with the functional group on the surface of the carbon black.

While the grafted carbon can be obtained by grafting the thus selected polymer on the carbon black, as described above, it is also possible to obtain the grafted carbon by polymerizing monomers. That is, the monomers are first bonded with the functional group on the surface of the carbon black, and the monomers bonded with the functional group are then polymerized. Such a grafted carbon obtained by the polymerization of the monomers can also be used as the electrically conductive agent in the charging roll of the present invention.

In preparation of the grafted carbon, the weight ratio of the polymer to the carbon black is suitably determined such that a desired effect of the grafted carbon is obtained. For assuredly achieving the objects of the invention, the weight ratio of the polymer which is grafted on the carbon black, to the carbon black is preferably 0.2–1.0. That is, the grafted carbon preferably has 20–100 parts by weight of the polymer per 100 parts by weight of the carbon black. As described above, the arrangement in which the activated surface of the carbon black is covered by the grafted polymer provides the advantages that the toner and additives are easily removed from the outer surface of the charging roll and that the dispersibility of the carbon black particles is improved. For assuring these advantages, it is preferable that the weight ratio of the polymer to the carbon black is 0.2 or more. Further, if the weight ratio of the polymer to the carbon black is excessively increased, the protective layer is considerably influenced by the properties or characteristics of the grafted polymer so that the protective layer is likely to suffer from a cracking on its surface or other problem when the protective layer is forced to be deformed. In this view, the weight ratio of the polymer to the carbon black is preferably 1.0 or less.

The grafted carbon can be prepared according to any known methods as described in the above-identified publications. In general, the polymer is grafted on the carbon black in a suitable dispersion medium (solvent) which is selected, depending upon the kind of the polymer, from among: water; alcohol such as methyl alcohol or ethyl alcohol; ketone such as acetone or methyl ethyl ketone; ester such as methyl acetate or ethyl acetate; and cellosolve. The amount of the dispersion medium to be used is suitably determined depending upon the kind of a chemical reactor employed for the preparation of the grafted carbon.

The selected carbon black, polymer and dispersion medium are first set in a suitable chemical reactor, and then stirred and mixed under heat, so that the carbon black and polymer react with each other. The chemical reactor may be, for example, a kneading apparatus such as a two-roller or three-roller type, or an agitating apparatus such as a ball mill or a bead mill, which apparatus includes a heating device for applying heat to the carbon black, polymer and dispersion medium, and a control device for controlling the operating temperature of the heating device. The chemical reaction operation in the chemical reactor is executed for about 1–10 hours, preferably 1–5 hours, while the reaction temperature is kept about 50–200° C., preferably 70–150° C.

In the thus obtained grafted carbon, the surface of the carbon black is covered by the polymer, so that the functional group existing on the surface of the carbon black is not exposed outside the surface of the grafted carbon. Thus, the particles of the carbon black are not polarized, thereby improving the dispersibility of the particles of the carbon black and accordingly preventing agglomeration or cohesion of the particles in the resin composition of the outermost protective layer 18.

The grafted carbon constructed as described above is added into the resin composition forming the outermost layer (protective layer 18) of the charging roll of FIG. 1 or FIG. 2, such that the content of the grafted carbon in the resin composition is generally 5–50 wt. %. If the content of the grafted carbon in the resin composition is smaller than the lower limit of 5 wt. %, it would be difficult to hold the electric resistance of the resin composition within the desired range. If the content of the grafted carbon is larger than the upper limit of 50 wt. %, the charging roll would suffer from problems that the electric resistance is excessively reduced to a value lower than the lower limit of the desired range, that the strength of the outermost layer is reduced possibly causing a cracking on the surface, and that the surface of the outermost layer is roughened. Therefore, the content of the grafted carbon in the resin composition is adjusted to be 5–50 wt. %, so that the outermost protective layer 18 has a volume resistivity within a range of $10^7$–$10^{15}$ Ω·cm, so that the charging roll sufficiently exhibits the required function of charging a photosensitive drum.

The resin composition constituting the outermost layer (protective layer 18) consists of a resin component (base resin component) which is a known resin material, and the electrically conductive agent in the form of the grafted carbon which is uniformly dispersed in the base resin component. In the charging roll according to the present invention, the base resin component preferably includes at least a fluorine-modified acrylate resin so as to assuredly attain the above-described objects of the present invention. As disclosed in JP-A-7-228820, the fluorine-modified acrylate resin which is included in the base resin component is a fluorine-modified acrylic resin wherein a fluorinated organic group such as a perfluoroalkyl group having 1–20 carbon atoms or a partially-fluorinated alkyl group having 1–20 carbon atoms is introduced into a polymer main chain of an acylic resin as a polymer side chain with or without a suitable organic bonding or coupling group being interposed between the polymer main chain of the acylic resin and the fluorinated organic group. Such a fluorine-modified acrylate resin is a polymer obtained by polymerization of at least one fluorinated acrylate or methacrylate and at least one other acrylate or methacrylate, i.e., at least one fluorine-unmodified acrylate or methacrylate. Examples of the fluorinated acrylate or methacrylate are perfluoroalkyl esters or partially-fluorinated alkyl esters of the acrylic acid or methacrylic acid, and esters of the acrylic acid or methacrylic acid wherein the fluorinated alkyl group as described above is attached to the polymer main chain of the acrylic resin via the organic bonding group. The polymer of the fluorine-modified acrylate resin may be copolymerized with a relatively small amount of polysiloxane-containing acrylate or methacrylate, as needed. The fluorine-modified acrylate resin exhibits further enhanced capability to prevent the toner particles from adhering to the surface of the protective layer 18 owing to copolymerization of the polysiloxane-containing acrylate or methacrylate.

The base resin component may further include a resin other than the fluorine-modified acrylate resin. For example, at least one of a fluorinated olefin resin and a fluorine-unmodified acrylate resin is preferably combined with the fluorine-modified acrylate resin, so as to cooperate with the fluorine-modified acrylate resin to constitute a binary or ternary resin composition for forming the base resin component of the protective layer 18. The combination of the fluorine-modified acrylate resin and the fluorinated olefin resin permits easy removal of the toner from the surface of the protective layer 18 even if the toner adheres thereto. The combination of the fluorine-modified acrylate resin and the fluorine-unmodified acrylate resin effectively increases adhesiveness of the protective layer 18 to the resistance adjusting layer 16. Further, if both of the fluorinated olefin resin and the fluorine-unmodified acrylate resin are used in combination with the fluorine-modified acrylate resin, the protective layer 18 formed of such a resin composition is capable of exhibiting excellent characteristics owing to a synergetic effect provided by the components as the base resin material.

The fluorinated olefin resin used in combination with the fluorine-modified acrylate resin is obtained by polymerization or copolymerization of a fluorinated olefin monomer such as tetrafluoroethylene, vinylidene fluoride, hexafluoropropylene or fluorinated vinyl ether. Examples of the fluorinated olefin resin are poly(vinylidene fluoride), a copolymer of vinylidene fluoride and tetrafluoroethylene, a terpolymer of vinylidene fluoride, tetrafluoroethylene and hexafluoropropylene, a copolymer of tetrafluoroethylene and hexafluoropropylene, and a copolymer of vinylidene fluoride and hexafluoropropylene.

The fluorine-unmodified acrylate resin used in combination with the fluorine-modified acrylate resin is obtained by polymerization of at least one fluorine-unmodified or non-fluorinated acrylate monomer, and is so-called acrylic resin. Described more specifically, the fluorine-unmodified acrylate resin is a homopolymer or a copolymer of acrylate monomer or monomers. For instance, such an acrylate monomer includes: alkyl esters such as methyl esters, ethyl esters, butyl esters, octyl esters or dodecyl esters of acrylic acid or methacrylic acid; hydroxyalkyl esters such as hydroxyethyl esters or hydroxybutyl esters of acrylic acid or methacrylic acid; and glycidyl esters of acrylic acid or methacrylic acid. It is particularly preferable to use a homopolymer of methyl methacrylate or a copolymer which contains methyl methacrylate as a major component.

The fluorinated olefin resin is used in combination with the fluorine-modified acrylate resin in an amount of about 5–95 wt. %, preferably in an amount of about 20–50 wt. %. That is, where the fluorinated olefin resin is combined with the fluorinated-modified acrylate resin, the weight ratio of the fluorinated olefin resin to the base resin component is adjusted to be about 5–95%, preferably about 20–50%.

The fluorine-unmodified acrylate resin is used in combination with the fluorine-modified acrylate resin in an amount of about 30–95 wt. %, preferably in an amount of about 35–65 wt. %. That is, where the fluorine-unmodified acrylate resin is combined with the fluorinated-modified acrylate resin, the weight ratio of the fluorine-unmodified acrylate resin to the base resin component is adjusted to be about 30–95%, preferably about 35–65%.

Where the fluorinated olefin resin and the fluorinated-unmodified acrylate resin are both combined with the fluorinated-modified acrylate resin, namely, where the base resin component consists of the fluorine-modified acrylate resin, the fluorinated olefin resin, and the fluorine-unmodified acrylate resin, the amounts of the three resin components are held within the respective ranges of 0.5–15 wt. %, 15–85 wt. %, and 10–75 wt. %, such that a total content of the three resin components is adjusted to 100 wt. %.

The protective layer 18, which is mainly constituted by the base resin component including at least the fluorine-modified acrylate resin, has a thickness which is suitably determined depending upon the particular application of the charging roll. In general, the thickness of the protective layer 18 is about 1–50 $\mu$m, preferably about 3–10 $\mu$m.

The charging rolls of the present invention as shown in FIGS. 1 and 2 may be produced in a known manner by using the above-described materials for the respective layers 12, 14, 16, 18. The soft base layer 12 is initially formed on the center shaft 10 by using the electrically conductive solid elastic material or the electrically conductive foamable material, according to a known method such as molding. On the outer circumferential surface of the obtained base layer 12, the softener-blocking layer 14 (in the first embodiment of FIG. 1 only), the resistance adjusting layer 16 and the protective layer 18 are formed with respective thickness values in the order of the description by a known coating method such as dipping, whereby the desired charging roll of FIG. 1 or 2 is obtained.

In the charging roll constructed according to the present invention, the soft base layer 12, the softener-blocking layer 14 (if provided), the resistance adjusting layer 16 and the protective layer 18 are laminated on one another in the order of the description, on the outer circumferential surface of the center shaft 10. The soft base layer 12 gives the charging roll the desired low hardness or high flexibility and excellent electric conductivity. The softener-blocking layer 14, which is provided as needed, serves to prevent bleeding of a softener such as an oil from the soft base layer 12. The resistance adjusting layer 16 serves to increase the withstand voltage or improve the dielectric breakdown resistance (resistance to leakage of electric current) of the charging roll.

Moreover, since the protective layer 18 includes the grafted carbon as the electrically conductive agent whose dispersibility is improved owing to its structure in which the surface of the carbon black is covered by the polymer, an even distribution of the electric resistance in the protective layer 18 is assured while the surface smoothness of the protective layer 18 is improved to such an extent that the protective layer 18 has a surface roughness Rz (ten point height of irregularities) of not larger than 3 $\mu$m, more preferably not larger than 2 $\mu$m. The improved surface smoothness of the protective layer 18 is effective to prevent or minimize adhesion or accumulation of the toner and additives to or on the surface of the roll, thereby effectively eliminating the conventionally experienced problem of the local variation of the electric resistance in the surface of the roll and accordingly making it possible to establish an even distribution of the electric resistance over the entire surface of the roll.

Further, owing to the structure in which the surface of the carbon black is covered by the polymer, the functional group existing on the surface of the carbon black is not exposed outside the surface of the grafted carbon. Thus, the particles of the carbon black are not polarized, thereby improving the ease of control of the electric resistance, and effectively eliminating the conventionally experienced problem of deterioration of the formed image due to the adhesion or accumulation of the toner and additives to or on the roll surface.

EXAMPLES

To further clarify the principle of the present invention, there will be described some examples of the charging roll constructed according to the present invention. However, it is to be understood that the invention is by no means limited to the details of these examples, but may be embodied with various changes, modifications and improvements which may occur to those skilled in the art, without departing from the scope of the invention.

Initially, seven types of grafted carbons (electrically conductive agents A–G) were prepared by grafting a styrene-acrylic polymer as a grafted polymer, into various types of carbon blacks as shown in Table 1, such that each grafted carbon had a predetermined graft ratio as indicated in Table 1. More specifically, for preparing each grafted carbon, predetermined parts by weight of the carbon black, predetermined parts by weight of the styrene-acrylic polymer, predetermined parts by weight of methylisobutylketone as a dispersion medium (solvent) were introduced into a chemical reactor in the form of a bead mill, while being stirred and mixed together at a temperature of 110° C. for 3 hours, so that the styrene-acrylic polymer and the carbon black reacted with each other. The predetermined parts by weight of the two materials and dispersion medium for preparing each grafted carbon were indicated in Table 2. It is noted that the above-indicated graft ratio represents a weight ratio of the grafted polymer to the carbon black, i.e., a ratio of the weight of the grafted polymer to the weight of the carbon black which was measured before the grafting.

Each carbon black had characteristics such as particle size, DBP (dibutyl phthalate) absorption number and pH, as indicated in Table 1, which were measured before the polymer was grafted on the carbon black. The particle size represents an arithmetic average of the size measured by an electron microscope. The DBP-absorption number represents an amount of DBP absorbed in 100 g of the carbon black when the DBP was added to the carbon black, and was determined according to a method defined in JIS-K-6221-A by using an absorptometer. The amount of the absorbed DBP was measured when the torque reached a prescribed value (maximum torque×0.7). The pH represents a pH value of a liquid obtained by mixing the carbon black into a distilled water, and the pH value was measured by a glass electrode meter according to a method defined in JIS-K-6221.

TABLE 1

| Conductive agent | Category | Characteristics of carbon black: Type of carbon black | Particle size (mm) | DBP-adsorption number (ml/100 g) | pH | Graft rate |
|---|---|---|---|---|---|---|
| A | Grafted carbon | LFF | 24 | 57 | 3.0 | 0.3 |
| B | | LFF | 22 | 100 | 3.5 | 0.5 |
| C | | LCF | 56 | 46 | 3.1 | 1.0 |
| D | | RCC | 32 | 395 | 4.8 | 0.2 |
| E | | RCC | 32 | 395 | 4.8 | 0.1 |
| F | | LCF | 56 | 46 | 3.1 | 2.0 |
| G | | FEF | 43 | 115 | 6.6 | 0.5 |
| H | Carbon black | LCF | 50 | 100 | 8.4 | 0 |
| I | Conductive titanium oxide | — | 200 | — | — | |

TABLE 2

| Conductive agent | Carbon black: Type | parts by weight | Styrene-acrylic polymer part by weight | Methylisobutylketone part by weight |
|---|---|---|---|---|
| A | LFF | 231 | 69 | 700 |
| B | LFF | 200 | 100 | 700 |
| C | LCF | 150 | 150 | 700 |
| D | RCC | 250 | 50 | 700 |
| E | RCC | 273 | 27 | 700 |
| F | LCF | 100 | 200 | 700 |
| G | FEF | 200 | 100 | 700 |

The thus obtained seven types of grafted carbons (conductive agents A–G) and other conductive agents H, I were used to obtain eleven specimens of the charging roll (as shown in FIG. 1) as indicated in Tables 3 and 4. Each of the roll specimens was produced in the following manner.

Initially, a cylindrical bar made of a ferrous material such as SUM22 was plated with nickel with a thickness of 5 $\mu$m by electroless plating so as to provide the center shaft 10 having a diameter of 8 mm, while materials for the soft base layer (12), the softener-blocking layer (14), the resistance adjusting layer (16) and the protective layer (18) were prepared in accordance with the compositions for the respective layers as described below. It is noted that the materials for the softener-blocking layer (14) and the resistance adjusting layer (16) were dissolved in methylethylketone so as to provide a coating liquid having a suitable viscosity value.

<<Composition for the Soft Base Layer (12)>>

| | (parts by weight) |
|---|---|
| Polynorbornene rubber | 100 |
| Zinc oxide | 5 |
| Stearic acid | 1 |
| Ketjenblack EC | 70 |
| Naphthenic oil | 400 |
| Vulcanization accelerator (TT) | 1 |
| Vulcanization accelerator (TBT) | 1 |
| Vulcanization accelerator (M) | 1 |
| Vulcanization accelerator (TL) | 0.5 |
| Sulfur | 1 |

Note:
TT = Tetramethylthiuramdisulfide
TBT = Tetrabutylthiuramdisulfide
M = Mercaptobenzothiazole
TL = Tellurium diethyldithiocarbamate <<Composition for the Softener-blocking Layer (14)>>

| | (parts by weight) |
|---|---|
| N-methoxymethylated nylon | 70 |
| Trimethylolmethoxymelamine | 30 |
| Ketjenblack EC | 15 |

<<Composition for the Resistance Adjusting Layer (16)>>

| | (parts by weight) |
|---|---|
| Epichlorohydrin rubber | 100 |
| Processing aid | 1 |
| Clay | 40 |
| Minium | 5 |
| Vulcanization accelerator 22 | 1.5 |
| Quaternary ammonium salt | 0.1 |

Note:
Vulcanization accelerator 22 = Ethylenethiourea

Subsequently, the center shaft 10 was placed in position within a molding cavity of a metal mold, and the molding cavity was then filled with the material for the soft base layer (12) having the above-described composition. The material for the soft base layer (12) was then vulcanized, so that the soft base layer 12 having a hardness of 20° (JIS-A hardness), a volume resistivity of $10^3$ Ω·cm and a thickness of 3 mm was formed integrally on the outer surface of the center shaft 10. After the mutually integrated center shaft 10 and soft base layer 12 were taken out of the metal mold, the soft base layer 12 was subjected to a known coating operation by dipping, using the coating liquids prepared for forming the softener-blocking layer (14) and the resistance adjusting layer (16), to thereby provide the softener-blocking layer 14 and the resistance adjusting layer 16 laminated in this order on the outer surface of the soft base layer 12. The resistance adjusting layer 16 was then vulcanized at a temperature of 160° C. for 45 minutes, to thereby provide an intermediate rubber roll in which the softener-blocking layer 14 has a volume resistivity of $10^3$ Ω·cm while the resistance adjusting layer 16 has a volume resistivity of $10^7$ Ω·cm and a thickness of 180 μm.

For providing the protective layer 18 as the outermost layer on the thus obtained intermediate rubber roll, each of the conductive agents A–I was mixed with the base resin component, by respective parts by weight as indicated in Tables 3 and 4, and the mixture of the conductive agent and the base resin component was dissolved in methylethylketone so as to provide a coating liquid for forming the protective layer (18). It is noted that the base resin component consisted of 10 wt. % of fluorine-modified acrylate resin (copolymer containing partially-fluorinated alkyl esters of acrylic acid and methyl methacrylate as major components), 40 wt. % of fluorinated olefin resin (copolymer of vinylidene fluoride and tetrafluoroethylene), and 50 wt. % of fluorine-unmodified acrylate resin (polymethyl methacrylate).

The thus obtained coating liquid was used to provide the protective layer 18 having a predetermined thickness as shown in Tables 3 and 4, on the outer circumferential surface of the intermediate rubber roll, i.e., on the surface of the resistance adjusting layer 16, so that a corresponding one of the eleven specimens of the charging rolls was prepared.

Each of the thus obtained eleven specimens of the charging rolls (Nos. 1–11) was evaluated with respect to its characteristics indicated in Tables 3 and 4. For measuring the volume resistivity of the protective layer 18 of each charging roll, a sample of the protective layer 18 was first prepared, apart from the charging roll, by using the same material as used for the protective layer 18 in the charging roll, and the volume resistivity of the sample was measured when 100V was applied thereto. For determining whether there was any cracking in the protective layer 18, the surface of the protective layer 18 was visually observed when the roll was installed in an image forming apparatus. Namely, the surface of the protective layer 18 was observed so as to check if there was any cracking on the surface of the protective layer 18 when the roll was forced to be deformed upon installation thereof in the image forming apparatus. The surface roughness (Rz) of the roll was measured according to JIS-B-0601.

The degree of adhesion of the toner to each specimen roll was evaluated as follows. Initially, the specimen roll was installed in a commercially available laser beam printer ("LASER-JET 4000" manufactured by JAPAN HEWLETT PACKARD Co., Ltd., Japan), so as to serve as its charging roll. Under the operating environment of 23° C. and 53%RH, a suitable image was successively printed on 1000 sheets of papers. After the printing, the toner adhering to the outer surface of each roll was removed by using a tape ("SCOTCH MENDING TAPE" available from SUMITOMO 3M COMPANY, Japan). The concentration of the toner transferred to the tape was measured by a densitometer (manufactured by X-RITE Company, U.S.A.). The thus measured concentration value represents the degree of adhesion of the toner to the outer surface of the roll.

In general, the outer surface of the black-colored roll appears to be covered by white powders of the additives added to the toner if the additives adhere to the roll. In this view, the degree of adhesion of the additives to each specimen roll was evaluated by observing the outer surface appearance of the roll. In the following Tables 3 and 4, "○" indicates that the outer surface of the roll kept almost black, or that a part or parts of the outer surface was lightly powdered by the white powders, "Δ" indicates that the entire outer surface of the roll was lightly powdered by the white powders, and "X" indicates that the entire outer surface of the roll appeared to be white rather than gray due to the white powders covering the entire surface.

The quality of image was evaluated by checking its halftone characteristics, after printing a suitable image on 5000 sheets under the operating environment of 15° C. and 10%RH while each specimen roll was used as the charging roll in the laser beam printer as described above. In the following Tables 3 and 4, "○" indicates that the formed image did not suffer from quality deterioration, "Δ" indicates that the formed image was tolerable for practical use, and "X" indicates that the formed image suffered from serious quality deterioration, and was not satisfactory for practical use.

TABLE 3

| Roll No. | 1 | 2 | 3 | 4 | 5 | 6 |
|---|---|---|---|---|---|---|
| Protective layer | | | | | | |
| Base resin component | | | | | | |
| parts by weight | 100 | 100 | 100 | 100 | 100 | 100 |
| Conductive agent | | | | | | |
| Type | A | B | B | B | C | D |
| parts by weight | 26 | 23 | 30 | 38 | 70 | 18 |
| Thickness (μm) | 5 | 6 | 5 | 4 | 4 | 6 |
| Volume resistivity (Ω.cm) | $5 \times 10^{13}$ | $2 \times 10^{12}$ | $5 \times 10^{12}$ | $8 \times 10^{12}$ | $2 \times 10^{14}$ | $1 \times 10^{11}$ |
| Characteristics of Roll | | | | | | |
| Cracking in protective layer | NO | NO | NO | NO | NO | NO |
| Surface roughness: Rz (μm) | 1.48 | 1.38 | 1.68 | 1.72 | 1.88 | 1.44 |
| Degree of adhesion of toner | 0.39 | 0.34 | 0.35 | 0.37 | 0.41 | 0.35 |
| Degree of adhesion of additives | ○ | ○ | ○ | ○ | ○ | ○ |
| Quality of image | ○ | ○ | ○ | ○ | ○ | ○ |

TABLE 4

| Roll No. | 7 | 8 | 9 | 10 | 11 |
|---|---|---|---|---|---|
| Protective layer | | | | | |
| Base resin component | | | | | |
| parts by weight | 100 | 100 | 100 | 100 | 100 |
| Conductive agent | | | | | |
| Type | E | F | G | H | I |
| parts by weight | 11 | 150 | 23 | 7 | 70 |
| Thickness (μm) | 5 | 5 | 5 | 6 | 5 |
| Volume resistivity (Ω.cm) | $2 \times 10^{11}$ | $4 \times 10^{13}$ | $4 \times 10^{11}$ | $5 \times 10^{11}$ | $2 \times 10^{11}$ |
| Characteristics of Roll | | | | | |
| Cracking in protective layer | NO | YES | NO | NO | NO |
| Surface roughness: Rz (μm) | 4.42 | 4.50 | 5.32 | 5.24 | 4.52 |
| Degree of adhesion of toner | 0.54 | 0.63 | 0.65 | 0.69 | 0.79 |
| Degree of adhesion of additives | Δ | x | x | x | x |
| Quality of image | Δ | Δ | Δ | x | x |

As is apparent from the results as indicated in the above Tables 3 and 4, the images formed by using the specimen rolls of Nos. 1–6 showed significantly high quality since these specimen rolls did not suffer from cracking on their surfaces and had relatively low degrees of adhesion of the toner and additives to their outer surfaces. In contrast, the specimen rolls of Nos. 10 and 11 in which carbon black or conductive titanium oxide was used as an electrically conductive agent had relatively high degrees of adhesion of the toner and additives to the outer surfaces of the rolls due to the increased surface roughness (Rz), thereby suffering from serious quality deterioration of the formed image, and failing to assure satisfactory quality suitable for practical use.

As is clear from the above description, the charging roll is constructed according to the present invention, such that the outermost layer which is held in contact with the photosensitive drum is formed of the resin composition including the electrically conductive agent in the form of the grafted carbon which is formed by grafting the polymer onto the carbon black, so that the dispersibility of the particles of the carbon black or grafted carbon is improved. This improved dispersibility of the particles leads to a sufficiently even distribution of the electric resistance value and an improved smoothness of the outer surface of the charging roll, whereby the toner and additives are advantageously prevented or minimized from adhering to or accumulating on the surface of the roll. Further, the covering of the surface of the carbon black by the grafted polymer not only improves the ease of control of the electric resistance, but also prevents the polarization of the respective particles of the carbon black, thereby further assuredly preventing the adhesion or accumulation of the toner and additives to or on the surface of the roll, which would cause the conventionally experienced problem of the deterioration of the formed image.

What is claimed is:

1. A charging roll which is held in rolling contact with a photosensitive drum for charging said photosensitive drum, said charging roll comprising an outermost layer formed of a resin composition containing a grafted carbon as an electrically conductive agent, said grafted carbon including a carbon black and a polymer which is grafted on said carbon black so as to cover a surface of said carbon black, said charging roll further comprising a center shaft, a soft base layer formed on an outer circumferential race of said center shaft, a resistance adjusting layer formed radially outwardly of said soft base layer, and a protective layer which is formed outwardly of said resistance adjusting layer and which serves as said outermost layer.

2. A charging roll according to claim 1, wherein the weight ratio of said polymer which is grafted on said carbon black, to said carbon black in said grafted carbon is 0.2–1.0.

3. A charging roll according to claim 1, wherein a content of said grafted carbon in said resin composition is 5–50 wt. %.

4. A charging roll according to claim 1, wherein said outermost layer has an outer surface which has a surface roughness: Rz of not larger than 3 $\mu$m.

5. A charging roll according to claim 1, wherein said outermost layer has a volume resistivity within a range of $10^7$–$10^{15}$ $\Omega\cdot$cm.

6. A charging roll according to claim 1, wherein said resin composition includes a fluorine-modified acrylate resin as a resin component of said resin composition.

7. A charging roll according to claim 6, wherein said resin composition further includes at least one of a fluorinated olefin resin and a fluorine-unmodified acrylate resin, as a resin component of said resin composition.

8. A charging roll according to claim 1, wherein said soft base layer consists of a solid elastic body which is electrically conductive.

9. A charging roll according to claim 1, wherein said soft base layer consists of a foam body which is electrically conductive.

10. A charging roll according to claim 1, further comprising a softener-blocking layer interposed between said soft base layer and said resistance adjusting layer.

11. A charging roll according to claim 1, wherein said carbon black has a pH of not larger than 5.

12. A charging roll which is held in rolling contact with a photosensitive drum for charging said photosensitive drum, said charging roll comprising an outermost layer formed of a resin composition containing a grafted carbon as an electrically conductive agent, said grafted carbon including a carbon black and a polymer which is grafted on said carbon black so as to cover a surface of said carbon black, wherein said outermost layer has an outer surface which has a surface roughness: Rz of not larger than 3 $\mu$m.

13. A charging roll according to claim 12, wherein a content of said grafted carbon in said resin composition is 5–50 wt. %.

14. A charging roll which is held in rolling contact with a photosensitive drum for charging said photosensitive drum, said charging roll comprising an outermost layer formed of a resin composition containing a grafted carbon as an electrically conductive agent, said grafted carbon including a carbon black and a polymer which is grafted on said carbon black so as to cover a surface of said carbon black, wherein said resin composition includes a fluorine-modified acrylate resin as a resin component of said resin composition.

15. A charging roll according to claim 14, wherein said resin composition further includes at least one of a fluorinated olefin resin and a fluorine-unmodified acrylate resin, as a resin component of said resin composition.

16. A charging roll according to claim 14, wherein a content of said grafted carbon in said resin composition is 5–50 wt. %.

* * * * *